US008220096B2

(12) United States Patent
Hui

(10) Patent No.: US 8,220,096 B2
(45) Date of Patent: Jul. 17, 2012

(54) POOL CLEANING VEHICLE HAVING INTERNAL DRIVE PROPULSION

(75) Inventor: Wing-kin Hui, Hong Kong (HK)

(73) Assignee: Goggles Cell Limited, Hong Kong (HK)

( * ) Notice: Subject to any disclaimer, the term of this patent is extended or adjusted under 35 U.S.C. 154(b) by 882 days.

(21) Appl. No.: 12/116,068

(22) Filed: May 6, 2008

(65) Prior Publication Data

US 2009/0276967 A1 Nov. 12, 2009

(51) Int. Cl.
*E04H 4/16* (2006.01)

(52) U.S. Cl. ... 15/1.7; 180/65.51; 180/65.6; 210/167.16

(58) Field of Classification Search ..... 15/1.7, 15/409, 412; 114/222; 134/172; 180/65.51, 180/65.6; 210/167.15, 167.16; 239/743–748
See application file for complete search history.

(56) References Cited

U.S. PATENT DOCUMENTS 2,923,954 A * 2/1960 Babcock ..... 15/1.7
3,337,889 A * 8/1967 West ..... 15/1.7
3,439,368 A * 4/1969 Myers ..... 15/1.7
3,676,884 A * 7/1972 Wulc ..... 15/1.7
3,938,608 A * 2/1976 Folco-Zambelli ..... 180/21
3,948,332 A * 4/1976 Tyner ..... 180/19.1
4,095,378 A * 6/1978 Urakami ..... 451/88
4,154,680 A * 5/1979 Sommer ..... 210/167.16
4,304,022 A * 12/1981 Sommer ..... 15/1.7
5,330,026 A * 7/1994 Hsu et al. ..... 180/181
5,685,385 A * 11/1997 Sanuga ..... 180/65.1
2007/0094817 A1 5/2007 Stoltz et al.
2008/0087299 A1 4/2008 Erlich et al.

* cited by examiner

*Primary Examiner* — Mark Spisich
(74) *Attorney, Agent, or Firm* — Peninsula IP Group; Douglas Chaikin

(57) ABSTRACT

Disclosed herein is a pool cleaning device including an internal drive assembly mounted outside the interior cavity of the device housing. The device including a pool cleaning vehicle, the vehicle including a housing defining a body shell and the body shell including an interior cavity and the pool cleaning vehicle including a drive assembly; and an internal drive assembly, the internal drive assembly including a motor assembly for engaging the vehicle drive assembly for propelling the vehicle, the motor assembly mounted outside the interior of the body shell.

5 Claims, 7 Drawing Sheets

POOL CLEANING VEHICLE HAVING INTERNAL DRIVE PROPULSION

FIELD OF THE INVENTION

This invention generally relates to the field of motor driven pool cleaning vehicle. More particularly, this invention relates to the structure for driving the pool cleaning vehicle located outside the interior volume of the housing of the pool cleaning vehicle.

BACKGROUND OF THE INVENTION

As shown in FIGS. 1 and 2, there are two basic kinds of pool cleaning vehicles. With particular reference to FIG. 2, there is shown the wheel embodiment of the pool cleaning vehicle 200. The pool cleaning vehicle 200 has a housing 202 defining a body and the body having an interior space (not shown). Within the interior space is the drive motor (not shown). The drive motor is connected to the drive wheels by a belt (not shown). As the rotor of the drive motor rotates the belt (not shown) move in connection therewith. The drive wheels 204 are connected to the belt and rotates corresponding to the belt and motor.

As can be easily seen from FIGS. 1 and 2, the belt is both inside and outside the interior. This means that the belt is exposed to the sun's uv rays and the pool's chemicals. Consequently, the belt cracks and loses its elasticity prematurely. Such premature wear is costly to the consumer and result is consumer dissatisfaction and great inconvenience.

Similarly with respect to FIG. 2, the roller drive embodiment 200*a* is belt driven and works in much the way as the wheel driven embodiment. In this embodiment, the drive roller 204*a* is connected to output of the motor. Consequently the drive roller rotates corresponding the rotations of the motor. As in the earlier embodiment, the motor is located within the interior of the housing 202*a*.

As described above, both embodiments include the drive motor within the interior space. In both embodiments the filter bag for collecting refuse from the filtered water. Quite clearly, the smaller the interior space, the less refuse can be collected. Thus, there is a need for increasing the space available for refuse collection and for doing so in a manner, which allows the pool cleaning vehicle to maintain all of its functions.

In order to increase the useable Interior space, it would be advantageous to reduce the number of elements in the housing of the pool cleaning vehicle.

Additionally, as the pool cleaning vehicle travels around the pool, it runs over various obstacles. Additionally, the elevation in the pool changes somewhat dramatically. It has been found helpful, just like in automobiles, to have a center of gravity that is lower rather than higher.

What is needed is a pool cleaning vehicle which maximizes interior space and also lowers the center of gravity, while allowing the pool cleaning vehicle to function in its normal manner.

SUMMARY OF THE INVENTION

The structure, in accordance with the present invention, is an internal drive assembly for a pool cleaning vehicle. The internal drive moves the motor assembly from the interior of the pool cleaning vehicle to a location in close proximity to the drive assembly for the pool cleaning vehicle.

Thus, It is an object of this invention is to provide an internal drive assembly for a pool cleaning vehicle which is location outside of the interior of the pool cleaning vehicle to provide greater space for the filtering assembly.

It is an additional object of this invention to provide such internal drive assembly for a pool cleaning vehicle having a roller drive assembly has the internal drive assembly located within the drive roller itself.

In accordance with the objects set forth above and as will be described and as will become herein, the internal drive assembly in accordance with this invention, comprises:

an internal drive propulsion assembly for a pool cleaning vehicle, the vehicle including a housing defining a body shell and the body shell having an interior for storage of a filter bag, and the pool cleaning vehicle including a drive mechanism including drive means for traveling around the underwater surface of the pool, the internal drive propulsion assembly comprising:

motor means for propelling the drive mechanism, the motor means mounted outside the interior of the body shell.

Additionally, in another exemplary embodiment, the vehicle includes a microprocessor. The microprocessor controls the movement of the vehicle, including left and right turns and its ability to escape from various obstacles.

In an exemplary embodiment of the internal drive assembly in accordance with the invention, the drive motor assembly is located within the drive roller embodiment of the pool cleaning vehicle. The drive assembly includes a gear assembly and the gear assembly is connected to the internal gear assembly of the drive roller, which, upon activation of the motor assembly correspondingly moves the drive roller.

In the wheel embodiment of the pool cleaning vehicle in accordance with the invention, the drive motor assembly is located outside the interior of the body shell and the internal drive assembly including a gear assembly is in close proximity to the drive wheel assembly and the drive wheel assembly including a gear assembly for mating connection with the internal drive gear assembly. Upon activation of the motor, the drive wheels correspondingly move.

It is an advantage of this invention to provide an internal drive assembly located outside of the interior body shell of the pool cleaning device.

BRIEF DESCRIPTION OF THE DRAWINGS

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

An exemplary embodiment of the internal, drive assembly for a pool cleaning device in accordance with the present invention generally denoted by the numeral 50 will now be described with reference to FIGS. 3-8.

Figure 1:
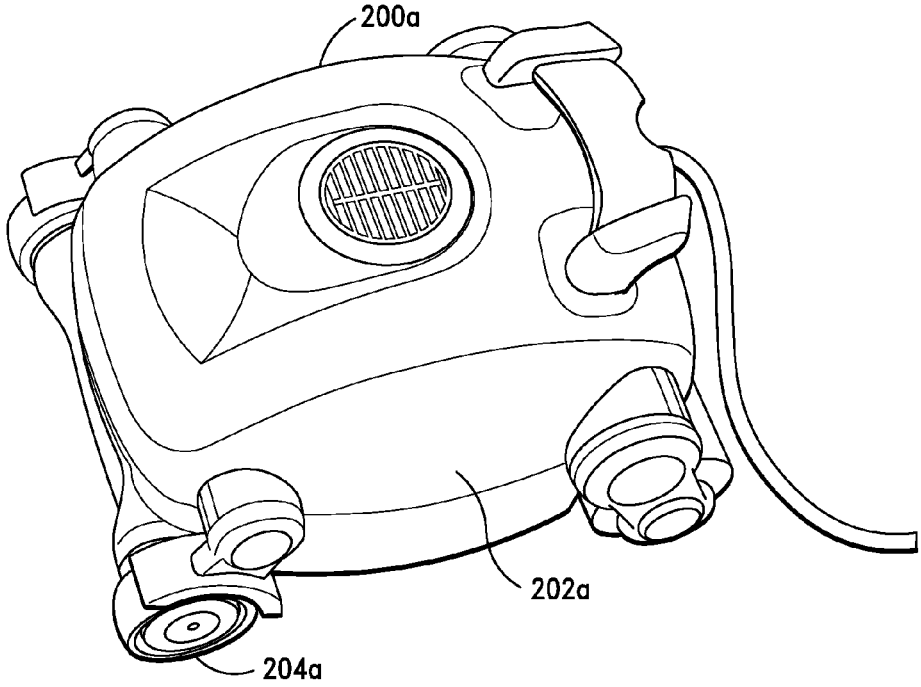
FIG.—1 (PRIOR ART)
FIG. 1 is a belt driven prior art pool cleaning device exhibiting a roller drive embodiment.
Figure 2:
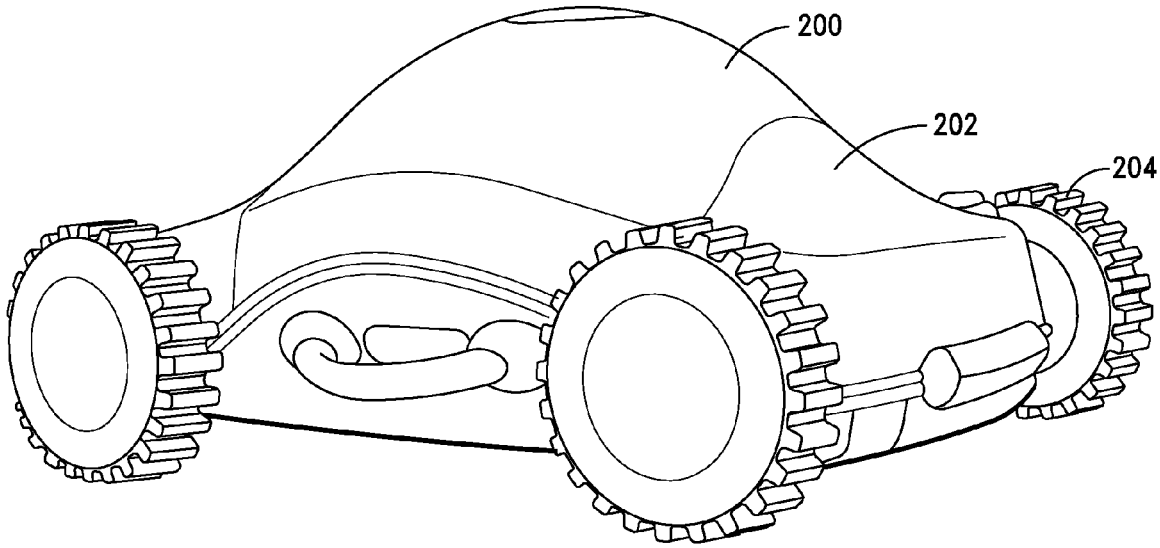
FIG.—2 (PRIOR ART)
FIG. 2 is a gear driven prior art pool cleaning device exhibiting a wheel drive embodiment.
Figure 3:
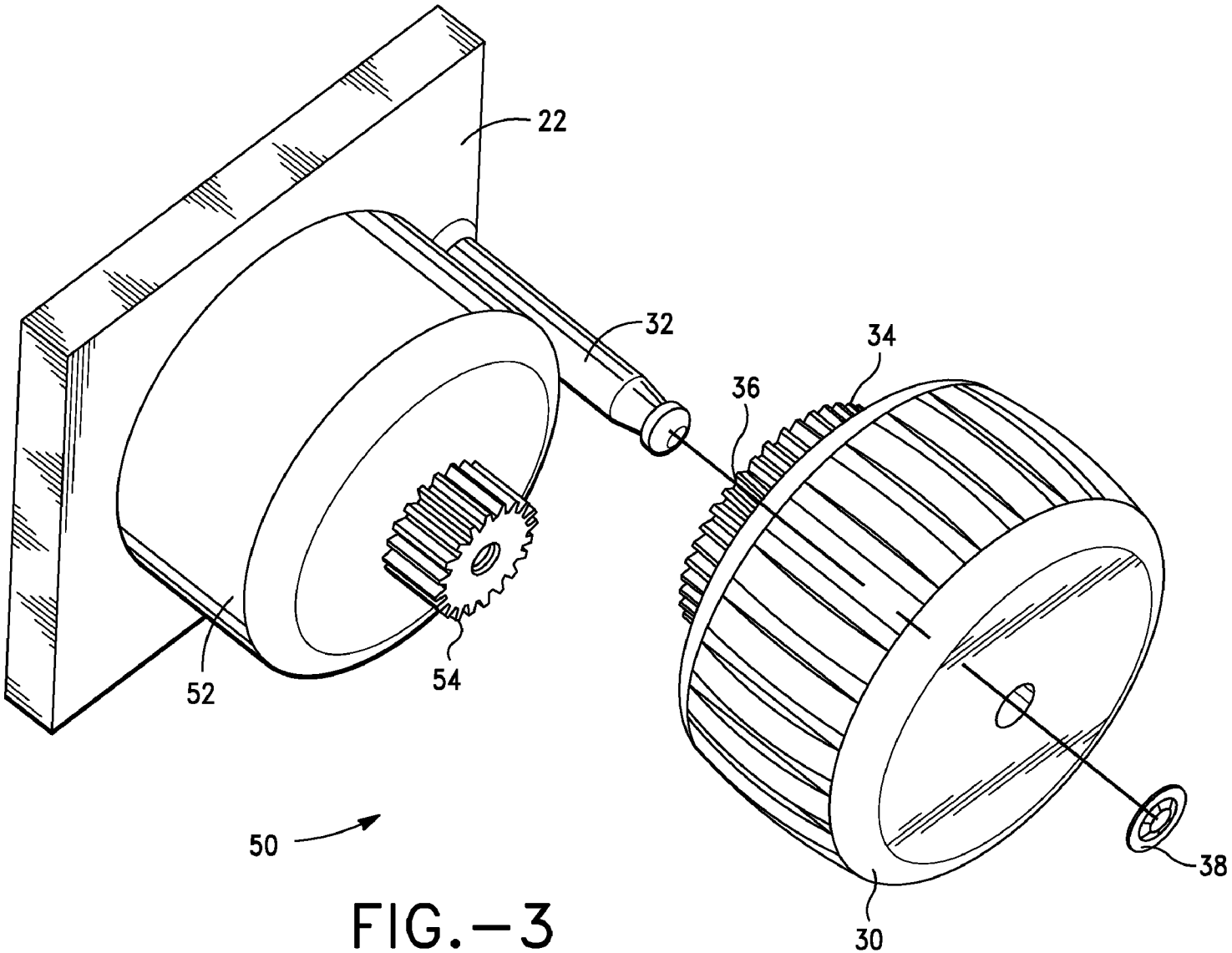
FIG. 3 is a perspective plan view of a single gear embodiment of the internal drive assembly in accordance with this invention.
Figure 4:
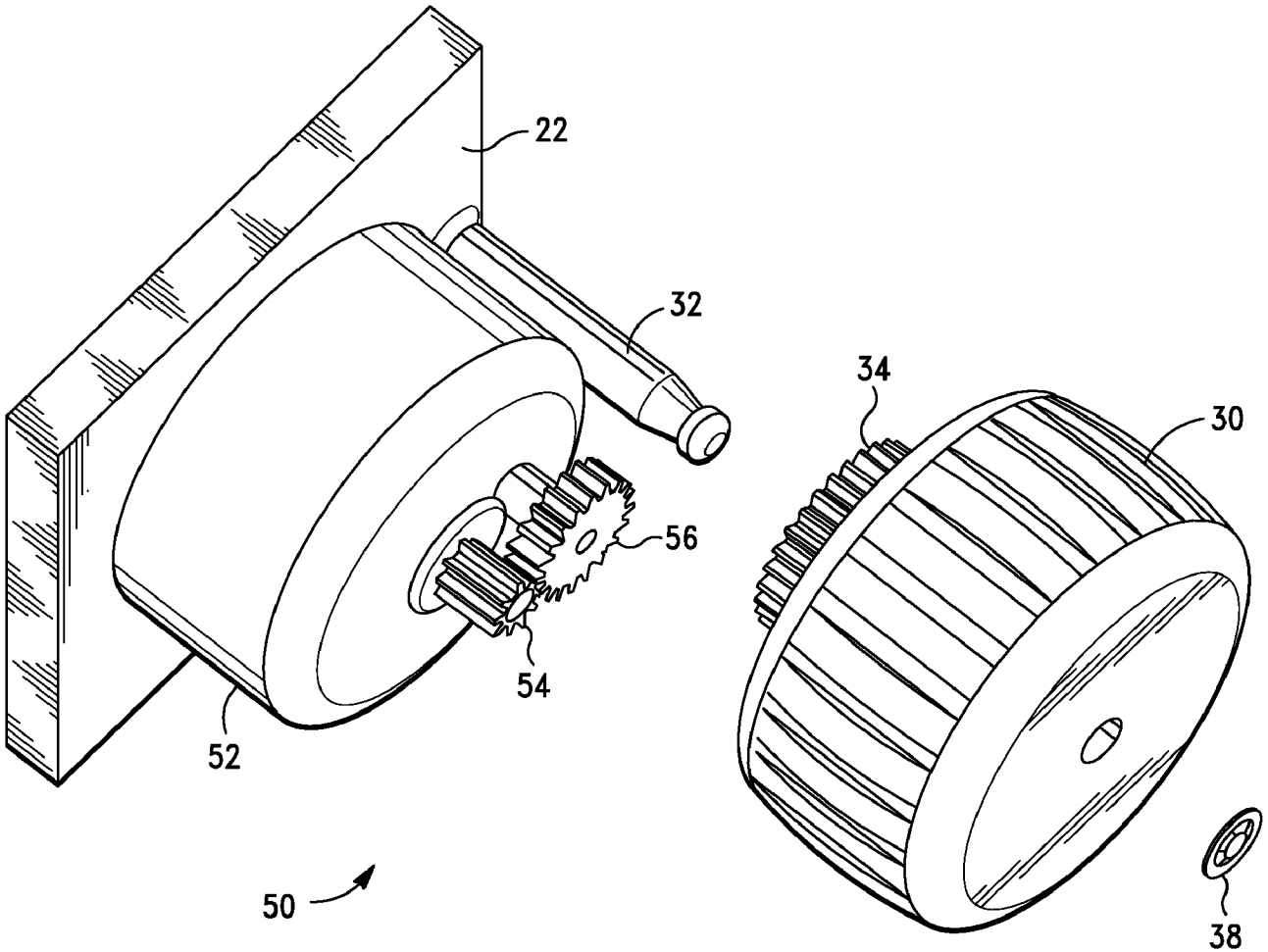
FIG. 4 is a perspective plan view of one multiple gear embodiment of the internal drive assembly in accordance with this invention.
Figure 5:
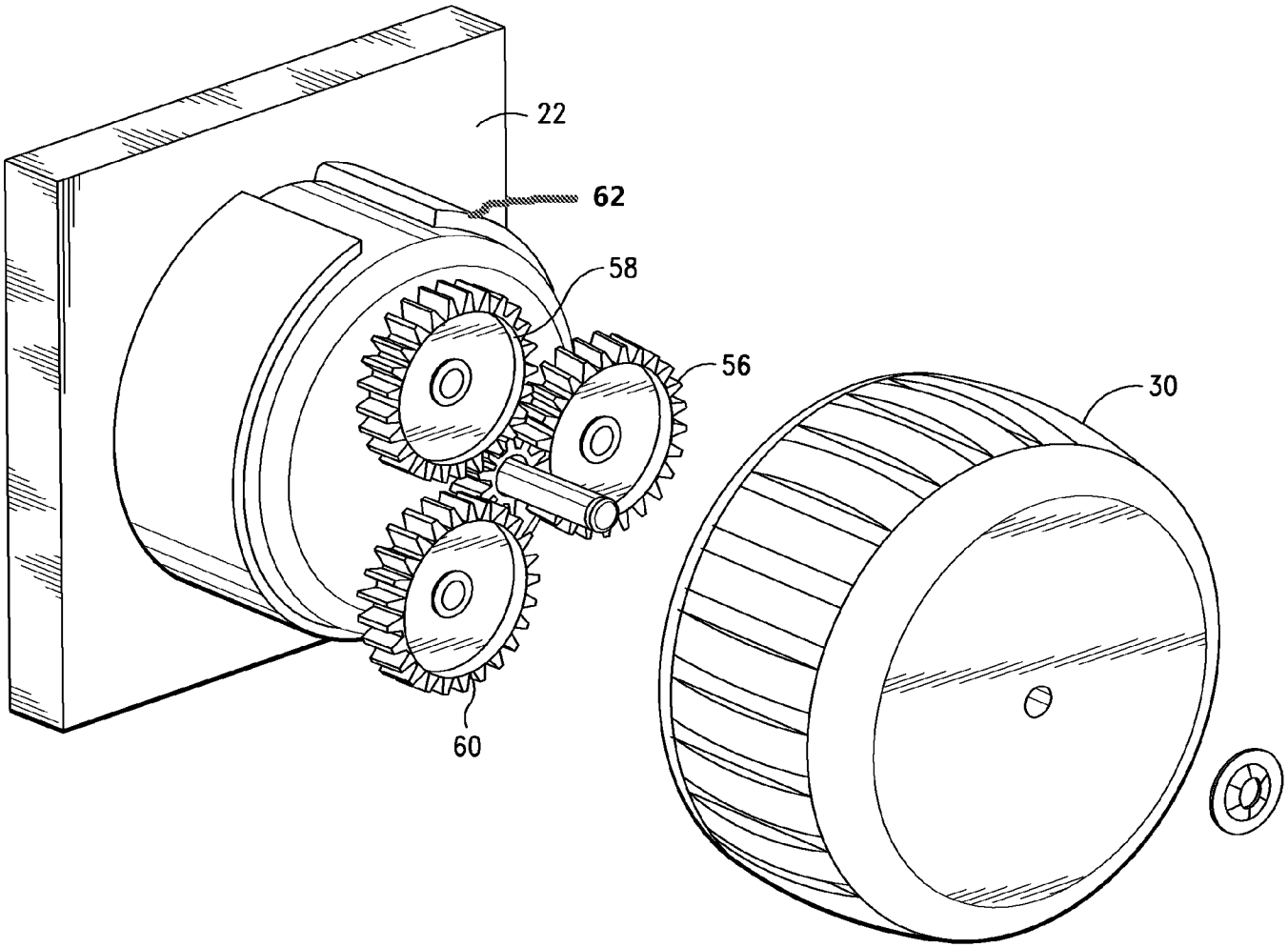
FIG. 5 is a perspective plan view of another multiple gear embodiment of the internal drive assembly in accordance with this invention.

Illustrated in FIGS. 3-5 is the embodiment of the pool cleaning vehicle which includes drive wheels 30. The internal drive assembly 50 includes a motor (not shown) with a housing 52 mounted on the exterior 22 of the pool cleaning vehicle 20. The motor includes a pinion gear 54, mounted on the rotor. When the motor rotates clearly so does the pinion gear.

The drive wheel 30 is securely and removeably mounted on an axle 32, in a manner conventional with pool cleaning vehicles. The drive wheel 30 includes an internal gear 34 having an opening 36 concentric with the axle opening of the drive wheel 30. Similar to the drive wheel 30, the gear 34 slides over the axle 32 and fits securely on the axle 32 so that the pinion gear 54 meshes properly with the internal gear 34. Thus, when the motor rotor turns, the drive wheel 30 turns.

The drive wheel 30 is locked in placed by a lock washer 38. The lock washer 38 is mounted concentric with the internal gear opening 36 and drive wheel 30.

The internal gear 34 in one embodiment is a separate element which is located as shown in FIG. 3. In another embodiment, the gear 34 is formed as an integral part of the wheel 30.

The housing 52 hermetically seals the drive motor. This protects the motor against damage that can be caused by the pool water and similar environmental issues. The drive wheel 30 rotates freely on the axle 32. And, as mentioned above does so in response to rotation by the motor.

It will be appreciated that, although not shown, within the housing 52, the motor, in another embodiment includes reduction gearing. This has the advantage of reducing drag and consequently wear. As is appreciated by those skilled in the art, the greater the rotation and speed of the motor the greater the wear rate on the seal. Therefore, by reducing the gearing and turning the motor slower as the rotor or shaft exits the housing, the sealed casing is maintained longer.

With particular reference to FIG. 4, there is shown another embodiment of the internal drive assembly 50. Here, the elements are the same as FIG. 3 with the exception that additional gear 56 is included. The additional gear 56 in one embodiment works as an idler gear. This allows the vehicle to move the motor mass to an appropriate location as a result of the buoyancy of the vehicle.

In another embodiment, the additional gear 56 serves as a further reduction gear for the drive assembly. In another embodiment, the additional gear is used to drive another device. Thus, the same motor is used to drive more than one device.

With particular reference to FIG. 5, there is shown a multiple additional gear embodiment of the internal drive assembly 50. As will be appreciated, as many as three additional gears may be included in the internal drive assembly in accordance with the invention herein. In other embodiments, 3 or more idler gears are used. With particular reference to FIG. 5, there are three additional gears, 56, 58 and 60. In this embodiment at least 2 of the gears serve as idler gears.

In this embodiment, wear and tear is shared among the number of idler gears, which could be as many as three. In other embodiments, more than three gears can be used. Also, this embodiment allows the distance between the output shaft and the wheel axle to be reduced. Finally, as can be seen from FIG. 5, the entire internal drive assembly 50 is enclosed by the drive wheel 30. In an additional embodiment the entire internal drive assembly is sealed by the enclosure.

In the embodiment shown in FIG. 5, the motor drive housing includes a bearing 62 for supporting and aligning the drive wheel 30. The bearing 62 in another embodiment is in the form of a bushing.

Figure 6:
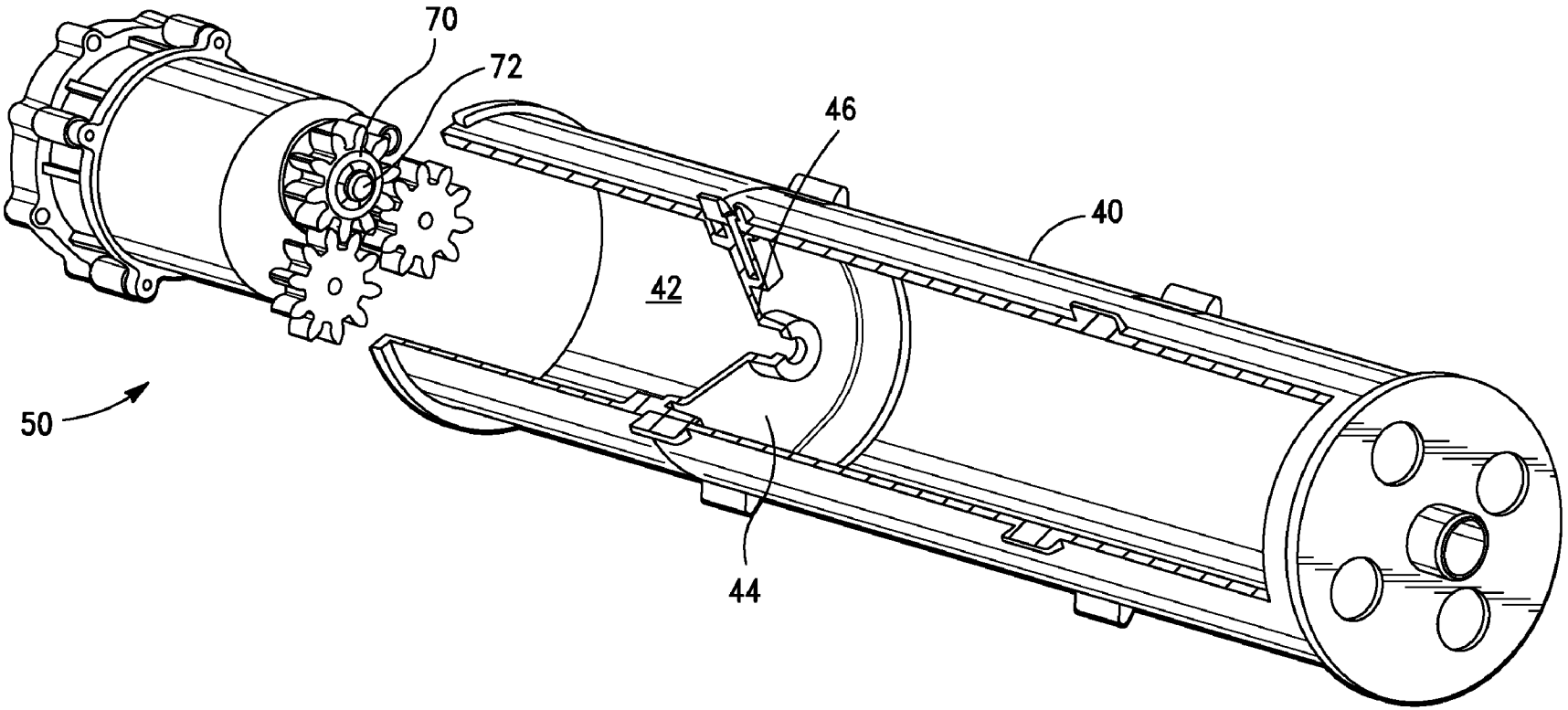
FIG. 6 is a perspective view of one exemplary embodiment of the roller drive pool cleaning vehicle having the internal drive assembly in accordance with this invention.
Figure 7:
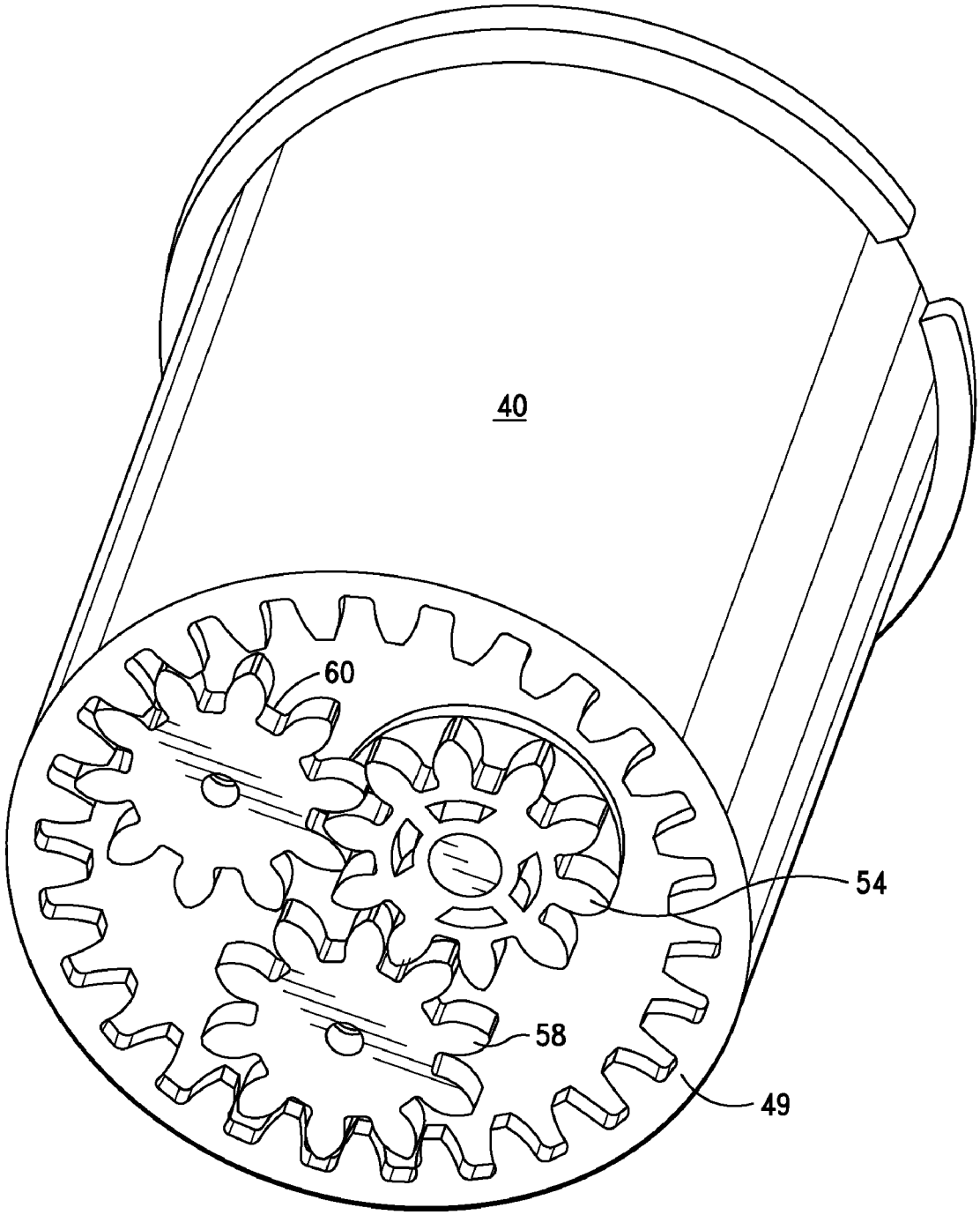
FIG. 7 is a perspective view of the drive gear assembly in the roller drive embodiment for the internal drive assembly in accordance with this invention.
Figure 8:
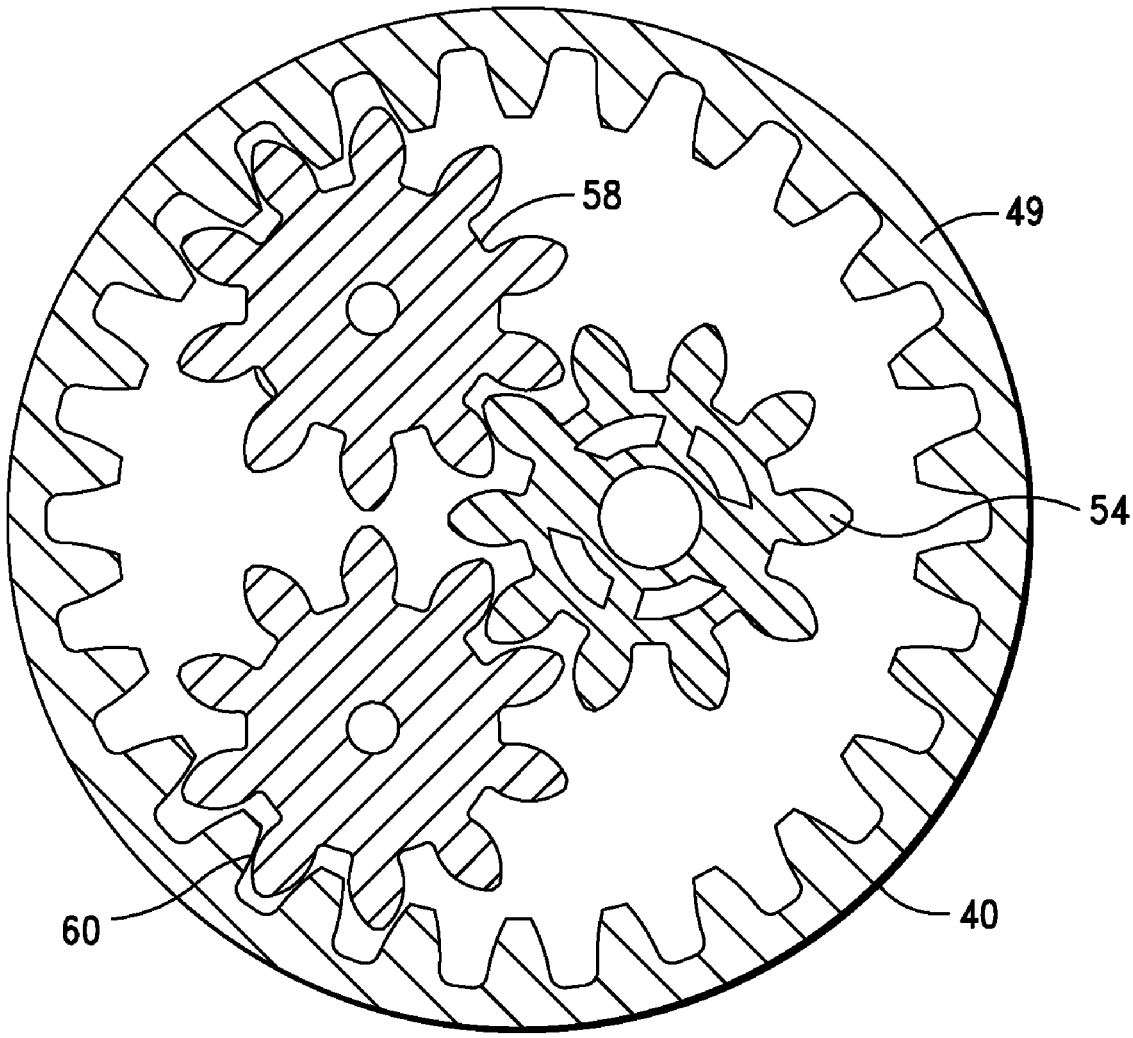
FIG. 8 is a cross sectional view of the gear assembly of FIG. 7.

With particular respect to FIG. 6-8, there is shown is the embodiment of the pool cleaning vehicle which includes roller drive 40 instead of wheels 30. The roller drive 40 has an interior 42. Within the interior 42 is a motor assembly mounting bracket 44. The mounting bracket 44 includes a journal 46.

The motor assembly slides into position in the interior 42 of the roller drive 40. A locking ring 70 includes a detent 72 extending therefrom. The detent 72 is sized and shaped to fit in the journal 46. Upon complete insertion into the interior 42, the motor assembly is journaled within the interior 42.

As shown in FIGS. 7 and 8, the drive roller 40 includes an internal gear 49. In the embodiment shown in FIGS. 6-8, there is shown the embodiment similar to FIG. 5, except there are only two idler gears 58 and 60 and pinion gear 54. And, similarly, the internal drive assembly works in the same fashion as described with respect to the earlier described embodiments in FIGS. 3-5.

While the foregoing detailed description has described several embodiments of the internal drive assembly in accordance with this invention, it is to be understood that the above description is illustrative only and not limiting of the disclosed invention. Particularly, there are variety of propulsion assembly used by pool cleaning vehicle and each of them is within the spirit and scope of the invention providing the drive motor is located outside the interior of the body shell. It also will be appreciated that there are various modifications to the internal drive that are within the spirit and scope of the invention herein and that of particular interest is the ability of the motor assembly to remain outside the interior of the body shell and not the specific type of gearing or drive chosen for operation. Thus, the invention is to be limited only by the claims as set forth below.

What is claimed is:

1. An internal drive assembly for a pool cleaning vehicle (PCV), the PCV including a housing defining a body shell and the body shell having an interior cavity and PCV including drive means for propelling the PCV around the underwater surface of the pool, the internal drive assembly comprising:

a drive motor assembly, the drive motor assembly mounted outside of the body shell for engaging the drive means, the drive means including drive wheels and the drive wheels including a gear assembly for engagement with the drive motor assembly.

2. The internal drive assembly of claim 1, wherein the internal drive assembly includes a gear assembly in compatible contact with the gear assembly, such that when the internal drive assembly is activated the drive wheels move.

3. The internal drive assembly of claim 1, wherein the internal drive assembly includes a pair of drive wheels and wherein each wheel includes a drive gear formed as an integral part of each drive wheel.

4. The internal drive assembly of claim 1, wherein the internal drive assembly includes a drive motor housing external of the body shell and wherein the housing hermetically seals the drive motor assembly.

5. In a pool cleaning vehicle (PCV), which includes a housing having a body shell, the body shell having an interior cavity and a drive means including a plurality of drive wheels for facilitating travel around the underwater surface of the pool, the body shell including a front portion, a rear portion and opposed lateral side portions between the front and rear portions, the improvement comprising:

a motor assembly mounted to a respective one of the lateral side portions of the body shell, the motor assembly engaging a respective one of the drive wheels for propelling the PCV, the motor assembly being mounted on an exterior surface of the body shell outside the interior cavity of the body shell.

* * * * *